United States Patent [19]

Ghering

[11] Patent Number: 4,754,723

[45] Date of Patent: Jul. 5, 1988

[54] APPARATUS FOR FOLDING A PONTOON UNIT

[75] Inventor: Jan Ghering, Gustavsburg, Fed. Rep. of Germany

[73] Assignee: Man Gutehoffnungshütte GmbH, Nürnberg, Fed. Rep. of Germany

[21] Appl. No.: 931,395

[22] Filed: Nov. 14, 1986

[30] Foreign Application Priority Data

Nov. 15, 1985 [DE] Fed. Rep. of Germany ..... 3540607

[51] Int. Cl.[4] ..... B63B 35/36

[52] U.S. Cl. ..... 114/353; 114/267

[58] Field of Search ..... 114/353, 77 R, 263, 114/352, 266, 267; 405/219

[56] References Cited

U.S. PATENT DOCUMENTS 4,223,623 9/1980 Brunet et al. ..... 114/353

*Primary Examiner*—Sherman D. Basinger

*Assistant Examiner*—Edwin L. Swinehart

*Attorney, Agent, or Firm*—Becker & Becker, Inc.

[57] ABSTRACT

A pontoon unit capable of folding up in a W-like manner. The two inner pontoons are connected by a center hinge, and the outer pontoons are pivotably connected to the inner pontoons by lower hinges via a lever. As an aid to overcome the buoyancy during unfolding, a tension spring is arranged between the lever and the outer pontoon. This spring is tensioned in the folded condition. After unfolding, the tension spring is virtually relaxed, and would be tensioned again for folding. This is avoided by interposing a variable-length connection member, typically a hydraulic piston/cylinder unit, between the tension spring and the outer pontoon. By being extended, this connection member avoids the need for the tension spring to be tensioned during folding. Only after the folding operation has been completed is the tension spring tensioned again by shortening the connection member.

2 Claims, 2 Drawing Sheets

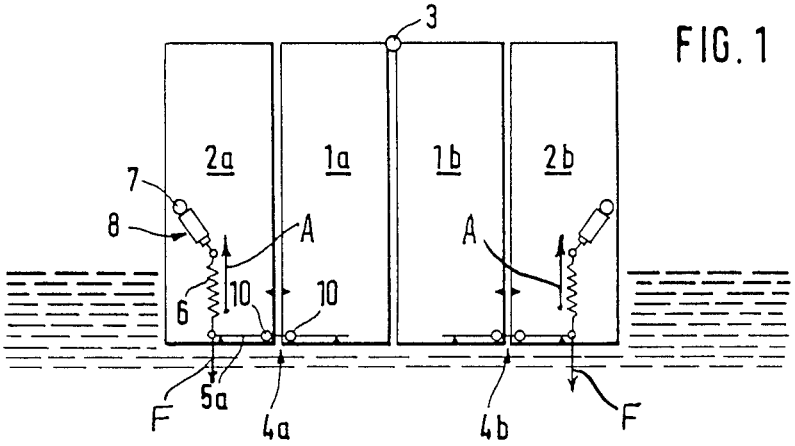
FIG. 1
FIG. 2
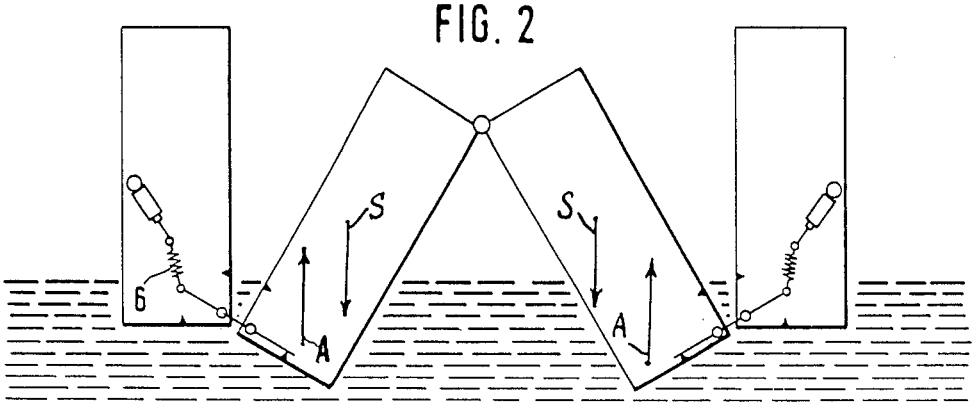
FIG. 3
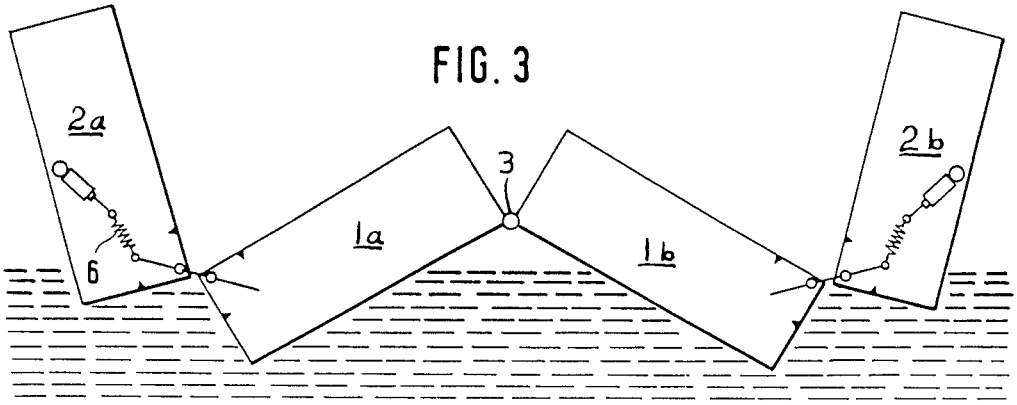

APPARATUS FOR FOLDING A PONTOON UNIT

BACKGROUND OF THE INVENTION

1. Field of the Invention

The present invention relates to an apparatus for folding a pontoon unit. The inner pontoons and two outer pontoons are interconnected by means of hinges in such a way that they can be folded and unfolded in a W-like manner. The two inner pontoons are connected by means of an upper center hinge, and the two outer pontoons are each connected by a lower hinge to their adjoining inner pontoon. Each lower hinge is formed by two pivots that are disposed in the adjoining corners of the inner and outer pontoons. The pivots are rotatably or pivotably connected by an overhanging lever, with the freedom of movement of the overhanging ends of said levers being capable of being limited by stops that are connected to the inner and outer pontoons. That end of each lever associated with an outer pontoon is connected to a tension spring.

2. Description of the Prior Art

An apparatus for unfolding a pontoon unit was disclosed in German Pat. No. 34 06 392 Ghering dated Sept. 5, 1985, according to which the outer pontoons of a pontoon unit that is capable of being folded W-fashion by tensioned tension springs are unfolded in opposition to the buoyancy force that acts on them. As a result, no separate assistance was required for unfolding. However, it has been found that it is necessary, for folding, to tension the initially relaxed tension springs, and that, without resorting to push boats, this is an undertaking calling for considerable physical effort.

In contrast to this, the object of the present invention is to provide a means to perform the folding of a pontoon unit without resorting to additional equipment in the form of push boats or similar facilities, and without excessive effort.

BRIEF DESCRIPTION OF THE DRAWINGS

This object, and other objects and advantages of the present invention, will appear more clearly from the following specification in conjunction with the accompanying schematic drawings, in which:

FIG. 1 is a view that shows one exemplary inventive embodiment of a W-shaped folded pontoon unit with a tension spring and connection member in the outer pontoon;

FIG. 2 is a view that shows the inner pontoon starting to unfold;

FIG. 3 is a view that shows the outer pontoon starting to unfold;

SUMMARY OF THE INVENTION

Figure 4:
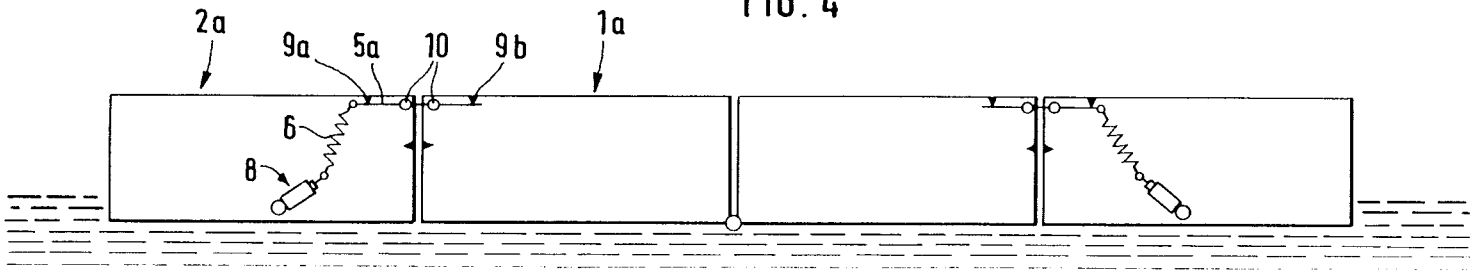
FIG. 4 is a view that shows a fully unfolded or extended pontoon unit.

The apparatus of the present invention is characterized primarily in that a variable-length connection or intermediate member is provided between a free end of the tension spring and a point where the latter is connected to the outer pontoon.

Due to the variable-length connection of the tension spring to the outer pontoon, it is possible, by shortening the connection member in the folded state to facilitate unfolding with the assistance of the tension spring. Prior to folding, the connection member is extended so that the spring will not be tensioned during folding and the buoyancy forces acting on the outer pontoon can be utilized fully for the folding operation, so that there is no need for either additional equipment or for excessive physical effort.

An advantageous further development of the present invention consists in having the connection member embodied as a hydraulic piston/cylinder unit where either the piston or the cylinder is connected to the free end of the spring, and conversely the cylinder or the piston is connected to the outer pontoon.

The hydraulic piston/cylinder unit represents an excellent means of obtaining a variable-length connection of the tension spring. It does not call for any physical effort, and can be adjusted in a minimum of time to the desired length.

Further specific features of the invention will be described in detail subsequently.

DESCRIPTION OF PREFERRED EMBODIMENTS

Referring now to the drawings in detail, FIG. 1 shows a pontoon unit consisting of two inner and two outer pontoons 1*a*, 1*b* and 2*a*, 2*b* in the folded state. At the top, the inner pontoons 1*a*, 1*b* are connected by a center hinge 3, whereas the outer pontoons 2*a*, 2*b* are connected to the inner pontoons 1*a*, 1*b* by lower hinges 4*a*, 4*b*. In view of the symmetry of the arrangement, only the left-hand half of the pontoon unit is discussed in the following. The lower hinge 4*a* is constructed as a lever 5*a* that is pivotably connected to the inner and outer pontoons 1*a*, 2*b* via pivots 10. That free end of the lever 5*a* associated with the outer pontoon 2*a* is connected to a tension spring 6 which, in turn, is connected to the pontoon 2*a*. Pursuant to the present invention, a variable-length connection or intermediate member 8 is interposed between the tension spring 6 and a connection location 7 on the pontoon 2*a*. The intermediate member 8 may advantageously be constructed as a hydraulic piston/cylinder unit.

In the phase illustrated in FIG. 1, the tension spring 6 is tensioned in order to compensate for the buoyancy forces acting on the outer pontoon 2*a*. FIGS. 2 and 3 illustrate intermediate phases as the pontoon unit unfolds. The spring 6 is relaxed as unfolding proceeds to an extent that is proportional to the amount that the resetting moment about the pivot 10 due to the buoyancy forces decreases and the driving or actuating moment due to the deadweight of the pontoon 2*a* increases.

FIG. 4 shows the pontoon unit in the ready-to-use state after unfolding has been completed. The tension spring is relaxed, and the lever 5*a*, which is rotatably supported on the pivots 10, is limited in its movement by the stops 9*a* and 9*b* of the inner and outer pontoons 1*a*, 2*a*.

Since, during folding, the tension spring 6 tends to become tensioned again, this would interfere with the folding movement. Therefore, the intermediate member 8 is extended so that, during folding, the tension spring 6 is not tensioned, whereby the folding operation can be achieved without a push boat and without superhuman effort, especially since the buoyancy forces assist the folding operation. It should be mentioned in this connection that the outer pontoons are acted upon by a buoyancy which exceeds the force due to their weight because the inner pontoons are considerably heavier on account of the propulsion engine, so that the depth of immersion of the outer pontoons is greater than would be expected for their weight.

Figure 5:
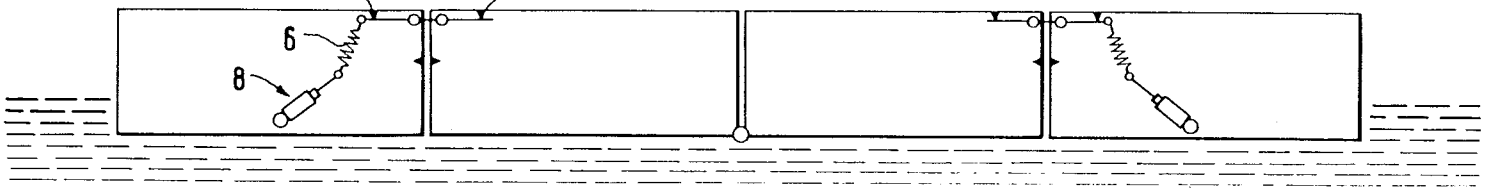
FIG. 5 is a view that shows a fully unfolded pontoon unit with the connection member extended in preparation for the folding operation.

FIG. 5 shows the intermediate member 8 extended in order to avoid tensioning of the tension spring 6 during folding. After folding into the state shown in FIG. 1, the intermediate member 8 is shortened, and the tension spring 6 is preloaded and prepared for the next unfolding operation.

The tensioning apparatus is generally a hydraulic piston/cylinder unit, but there is also conceivable to use a screw-and-nut mechanism or equivalent mechanisms, which are known per se.

The present invention is, of course, in no way restricted to the specific disclosure of the specification and drawings, but also encompasses any modifications within the scope of the appended claims.

What I claim is:

1. An apparatus for folding without any additional equipment such as push boats as well as without excessive physical effort and automatically unfolding a pontoon unit, comprising:

two inner and two outer pontoons that are interconnected laterally adjacent to each other in such a way that they can be folded and unfolded in a W-like manner; each of said pontoons has opposed ends, with a given end of each of said inner pontoons being interconnected by a center hinge, and the opposite ends of said inner pontoons being respectively connected to a given end of an adjacent one of said outer pontoons via respective further hinges, with each of the latter being formed by two pivot means, one in each of two contiguous corners of adjacent ones of said inner and outer pontoons, with said pivot means being pivotably interconnected via a lever that has two ends, including a first end that extends into the region of a given one of said outer pontoons beyond that pivot means disposed in the latter, and a second end that extends into the region of the adjacent inner pontoon beyond that pivot means disposed in the latter;

stops provided on said inner and outer pontoons for limiting movement of said first and second ends of said lever;

a respective tension spring connected to each of said outer pontoons, with each tension spring having a first end connected to said outer pontoon at a connection location, and a second end that is connected to said first end of said lever; and a variable-length connection member interposed between said first end of said tension spring and said connection location, said pontoon unit when fully unfolded having said connection member extended in preparation for folding operation and due to provision of said variable-length connection member with said tension spring, it is possible, by shortening said connection member in a folded state to facilitate unfolding with the assistance of said tension springs since prior to folding, said connection member is extended so that said spring will not be tensioned during folding and buoyancy forces acting on said outer pontoon can be utilized fully for the folding operation so that need for additional equipment and excessive physical effort is obviated.

2. An apparatus according to claim 1, in which said variable length connection member is in the form of a hydraulic piston/cylinder unit, with one of said piston and said cylinder being connected to said first end of said tension spring, and the other thereof being connected to said connection location of said outer pontoon.

* * * * *